United States Patent [19]

Holbert

[11] 3,969,158

[45] July 13, 1976

[54] PROCESS FOR TREATING 9% NICKEL STEEL

[75] Inventor: Albert S. Holbert, Garland, Tex.

[73] Assignee: Youngstown Sheet and Tube Company, Youngstown, Ohio

[22] Filed: Aug. 10, 1972

[21] Appl. No.: 279,521

[52] U.S. Cl. ..... 148/16.5; 148/31.5; 148/125

[51] Int. Cl.[2] ..... C23C 11/12; C21D 6/04

[58] Field of Search ..... 148/31.5, 125, 16.5, 148/143, 144; 75/123 K

[56] References Cited

UNITED STATES PATENTS

| | | | |
|---|---|---|---|
| 2,451,469 | 10/1948 | Brophy et al. | 148/31 |
| 2,532,117 | 11/1950 | Newell | 148/31 X |
| 2,992,148 | 7/1961 | Yeo et al. | 75/123 K |
| 3,366,471 | 1/1968 | Hill et al. | 148/31 X |
| 3,645,721 | 2/1972 | Savas | 75/123 K |

FOREIGN PATENTS OR APPLICATIONS

| | | | |
|---|---|---|---|
| 1,079,036 | 8/1967 | United Kingdom | 75/123 K |

OTHER PUBLICATIONS

Metals Handbook, 8th Ed., vol. 2, 1964, pp. 107–111.
Metals Handbook, 1948 Ed., pp. 683–685.

*Primary Examiner*—C. Lovell
*Attorney, Agent, or Firm*—Vinson, Elkins, Searls, Connally and Smith

[57] ABSTRACT

A heat treatment of nine percent nickel steel including carburizing, double normalizing, tempering, subcooling and then tempering to provide a steel having useful mechanical properties at extremely low temperatures.

3 Claims, No Drawings

PROCESS FOR TREATING 9% NICKEL STEEL

This invention relates to nine percent nickel steel and more particularly to the method of heat treating nine percent nickel steel.

Nine percent nickel steel is a well known alloy with the alloying elements and mechanical properties defined by the American Society for Testing and Materials. The Society also sets forth methods of heat treating nine percent nickel steel. In addition, the publication "Nickel Topics" Volume 13, No. 1, 1960 suggests a different method for treating nine percent nickel steel.

Other methods which have been suggested are:

1. To carburize at a carbon potential of 0.90 for 1 hour at 1600°F., then air cool in a controlled atmosphere and refrigerate 1¾ hours at −100°F. The final step is the tempering at 30°F. for 1 hour.

2. Carburize at 1700°F. for the desired case depth, then furnace cool to 1400°F. and finish cool. Thereafter, the steel is reheated to 1475°F. and soaked the equivalent to 1 hour per inch of section. After soaking the steel is oil quenched and then cooled to −100°F., after which it is tempered at 350°F.

None of these known heat treating methods will result in steel having the desired mechanical characteristics at extremely low temperatures such as −265°F., the temperature needed for handling liquified natural gas.

It is an object of this invention to provide a nine percent nickel steel having mechanical properties which permit it to be used to handle extremely low temprature products such as liquified natural gas.

Another object is to provide a nine percent nickel steel which may be used as working parts of a mechanical apparatus in extremely low temperatures.

Another object is to provide a nine percent nickel steel which may be used to fabricate swivel joints to be used in systems such as loading arms handling extremely cold liquids such as liquified natural gas.

Other objects, features and advantages of this invention will be apparent from the specification and the claims.

While the steel of this invention is extremely useful in low temperature applications, it may, of course, be used in other service.

Nine percent nickel steel has an extensive background for low temperature applications as regards to pressure vessels and other process equipment. This steel is covered by American Society for Testing and Materials standard specifications A-353, A-333 Grade 8, A-334 Grade 8 and A-522. These specifications set out the mechanical properties and chemical requirements of this steel.

Nine percent nickel alloy steel provides an excellent carburizing material. The principal advantage being the elimination of distortion and quench cracking by slow cooling from the carburizing treatment. Normal case hardness of Rockwell "C" 60 can be developed with a tough core at room temperature. Impact properties at low temperature are not acceptable and this treatment has not been recognized for low temperature applications in the range of −265°F. or −320°F.

For instance, a specimen of nine percent nickel alloy steel was gas carburized, air cooled, refrigerated 1¾ hours at −100°F. and then tempered at 300°F. for one hour. The case depth was 0.013 inch. The case hardness was 60 R"c" and the core hardness was 34 R"c".

The energy absorbed in the carburized specimen, however, is below requirements of 25 ft. lb. The charpy "V" impact of the carburized specimen at −320°F. was 7.4 ft. lbs. The non-carburized portion of the specimen was 36.0/33.1 ft. lbs. These tests were made by other parties.

The method of heat treatment in accordance with this invention shows markedly superior toughness and the carburized and non-carburized material meet code requirements at −265°F. thus permitting use of the material as swivel joints or the like for handling liquified natural gas.

While the method of this invention may be used with or without carburizing it is particularly useful in treating carburized material such as swivel joints and the disclosure herein will be directed to material which is selectively carburized to provide surfaces suitale for use as ball races or the like.

The specimen to be treated such as the body and nipple of swivel joints are rough finished. Those surfaces not to be carburized are then protected such as by copper plating.

The semi-finished parts may be carburized with any suitable carbonaceous material, solid, liquid or gas. Natural gas, butane and propane are commonly used gases. The carburizing potential of these carbonaceous materials may be adjusted to the desired level by any of several well-known methods.

In carburizing, the carbon potential and the time of the carburizing step will be adjusted to obtain the desired case depth. As an example an atmosphere having a carbon potential of 0.70 to 0.80 percent may be used for 40 percent of the total calculated carburizing time to get the desired case depth. This time, for instance, may be about 12 hours. The carburizing step would be completed with a potential of 0.50 to 0.60 percent and the time of this remaining cycle may be 16 hours.

The carburizing step is preferably carried out at about 1600° to 1750°F. As those skilled in the art are aware, the temperatures at which carburizing is carried out are not critical but a temperature at about the range specified should be used.

After the carburizing step is completed the temperatue of the parts is reduced in the furnace by reducing the furnace temperature to about 1450° to 1550°F. This will reduce scaling on the steel during subsequent air cooling.

After carburizing and reducing the temperature of the steel parts in the furnace, they are removed from the furnace and cooled. Preferably, the steel parts are air cooled in the conventional manner to something near room temperature.

The parts are then double normalized to refine the grain and to provide toughness. Additional normalizing steps could be utilized if desired but a double normalizing treatment in accordance with this invention will suffice. The normalizing is preferably carried out in the same furnace as the carburizing and in a controlled atmosphere which is neutral to carbon so that the carbon content in the carburized parts will not change. This is normally done by reducing the carbon potential of the gas to a neutral level.

In the first normalizing treatment the parts are normalized at approximately 1650° to 1750°F. Again this range is not critical but a temperature of this magnitude should be utilized. The parts should be soaked at least 1 hour per inch of thickness. In the normalizing steps the furnace is first brought up to temperature and then the parts are placed in the furnace. This will cause the furnace temperature to drop. When the furnace temperature again reaches the soaking temperture the time for soak is begun.

After the first normalizing step the steel parts are cooled, preferably by removing them from the furnace and air cooling with circulated or forced air to a temperature close to room temperature.

The second normalizing step is carried out at about 1435° to 1465°F., preferably at 1450°F. Again this range is not critical but the soak should be carried out at a temperature of about this range. After the furnace has returned to the soaking temperature the parts should soak at least about one hour per inch of thickness. As those skilled in the art will understand the one hour soaking time is not critical but is a sufficient amount of time to insure that the normalizing steps have been carried out.

After the second normalizing step is completed the parts are cooled, preferably by circulated air to a temperature close to room temperature.

The parts are then tempered. The metal is tempered at about 1050° to 1125° and preferably at 1100°F. Again this range is not extremely critical but the tempering step should be carried out at a temperature of about 1100°F. Regardless of the thickness of the metal it should be raised to a uniform temperature and then soaked for at least about two hours.

The tempered metal is then removed from the furnace and cooled preferably by air cooling to a temperature approaching room temperature.

At this time the copper plating may be removed.

The carburized surfaces are now surface heated to further harden such surfaces. This is done by progressively heating and immediately cooling the surfaces so that the core of the metal is not affected and only the surface is brought to the hardening temperature. The surface may be heated in any desired manner as by a high frequency induction or a flame. In either event the part will normally be revolved past the source of heat and then immediately moved into a cooling air stream. These very hard surfaces should be cooled by air as a rapid cooling might induce cracks.

The surface hardening should be carried out at a temperature of about 1450° to 1525°F. These temperatures are not absolutely critical but a temperature in this general vicinity should be obtained to give the desired hardness to the carburized surfaces.

In order to stabilize both the case-hardened and the core portions of the metal to low temperature service, the parts are cooled to at least approximately −120°F. At about −120°F. stabilization is attained. Preferably the parts are cooled to −150°F. to insure complete stabilization. The cooling soak is carried out for about 1 hour after the parts are uniformly cool. Thereafter the parts are brought back to approximately room temperature as for instance by removing them from the refrigeration unit and permitting them to stand. Forced air may be utilized if desired to hasten the return of the parts to room temperature.

A final tempering step to stress relieve metal is carried out at about 300°to 350°F. Again this temperature range is not critical but a temperature of about this range should be utilized. The parts should be brought up to a uniform temperature and then soaked for approximately 2 hours after which they may be finished as by grinding the ball races to the final dimensions.

As noted above the temperature ranges and times for this process are not critical but times and temperatures of about the ranges specified should be used.

An eight inch swivel joint was manufactured in accordance with this invention. The maximum wall thickness of the joint was approximately 1½ inches.

The surfaces that were not to be carburized were copper plated. The swivel joint was carburized at 1650°F. using natural gas and adjusted to a carbon potential of between 0.70 and 0.80 percent for 40 percent of the total calculated carburizing time. The remaining 60 percent of the time the potential of the gas mixture was 0.50 to 0.60 percent. The total time for carburizing was 28 hours. The swivel joint parts were then cooled in the furnace to 1550°F. after which they were air cooled.

The parts of the joint were double normalized first at 1650°F. and second at 1450°F. Each normalizing step was for 2 hours after the furnace returned to 1650° following the temperature drop upon insertion of the swivel joint. After each normalizing step the parts were removed and air cooled with circulated air.

The parts were then returned to the furnace and tempered at 1100°F. for 2 hours after the metal had become uniformly hot.

The parts were removed from the furnace and air cooled to approximately room temperature and then subcooled in a refrigeration unit to −150°F. This temperature was held for one hour after the parts were uniformly cold.

The parts were removed from the refrigerator and permitted to reach approximately room temperature and were then tempered for one hour per inch of thickness at 350°F. The parts were removed from the furnace and permitted to air cool without artificial cooling. Thereafter they were tested with the following results.

At room temperature the case tested 58 R(c) as a minimum. The core ranged from 20 to 30 R(c). At −320°F. the charpy "V" impact of core resulted in 25 ft. lbs. minimum. At −265°F. the charpy "V" impact of carburized samples with 0.025/0.30 inch case at notch was 25 ft. lbs. minimum.

The tensil properties of the core conformed to ASTM requirements.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. The method of treating nine percent nickel steel comprising, carburize selected surface areas at about 1600° to 1750°F. for sufficient time to obtain the desired case hardened properties and air cool, normalize at about 1650° to 1750°F. for at least about one hour per inch of thickness and air cool, again normalize at about 1450°F. for at least about one hour per inch of thickness and air cool, temper at about 1100°F. for about 2 hours after the steel is uniformly hot and air cool, surface harden selected carburized surfaces by heating them to about 1450° to 1525°F. and immediately air cooling such surfaces after they have reached the desired temperature, subcool to at least about −120°F. for about 1 hour after the steel is uniformly cold and warm, and temper at about 300° to 350°F. for about 2 hours after the steel is uniformly hot and cool.

2. The method of treating nine percent nickel steel comprising, carburize selected surface areas at about 1600° to 1750°F. for sufficient time to obtain the desired case hardened properties, cool with forced air, normalize at about 1650° to 1750°F. for about at least one hour per inch of thickness, cool with forced air, again normalize at about 1435° to 1465°F. for at least about 1 hour per inch of thickness, cool with forced air, temper at about 1100°F. for about 2 hours after the steel is uniformly hot, cool with forced air, surface heat selected carburized surfaces to about 1450° to 1525°F. and immediately air cool such surfaces after they have reached the desired temperature, then subcool to at least about −120°F. after the steel is uniformly cold and warm, and then temper at about 300° to 350°F. for about 2 hours after the steel is uniformly hot and cool.

3. The method of claim 2 wherein the normalizing steps are carried out in an atmosphere substantially neutral to carbon transfer.

* * * * *